US005914462A

United States Patent [19]

Fujii

[11] Patent Number: 5,914,462

[45] Date of Patent: Jun. 22, 1999

[54] COMPOSITE INSULATOR HAVING END FITTINGS WITH GAPS

[75] Inventor: Shuji Fujii, Komaki, Japan

[73] Assignee: NGK Insulators, Ltd., Japan

[21] Appl. No.: 08/934,075

[22] Filed: Sep. 19, 1997

Related U.S. Application Data

[63] Continuation of application No. 08/600,128, Feb. 12, 1996, abandoned.

[30] Foreign Application Priority Data

Feb. 21, 1995 [JP] Japan ..... 7-32670

[51] Int. Cl.[6] ..... H01B 17/06

[52] U.S. Cl. ..... 174/179; 174/196; 174/189

[58] Field of Search ..... 104/174, 176, 104/178, 189, 209, 179, 194, 195, 196, 177

[56] References Cited

U.S. PATENT DOCUMENTS

| | | | |
|---|---|---|---|
| 3,081,375 | 3/1963 | Moussou | 174/179 |
| 4,296,274 | 10/1981 | Cookson | 174/142 |
| 4,355,200 | 10/1982 | Wheeler et al. | 174/140 S |
| 4,435,615 | 3/1984 | Kaczerginski et al. | 174/189 |
| 4,476,081 | 10/1984 | Kaczerginski et al. | 264/262 |
| 4,885,039 | 12/1989 | Thevent | 156/294 |
| 4,973,798 | 11/1990 | Parraud et al. | 174/176 |

OTHER PUBLICATIONS

Sediver Brochure, "Armourlite Suspension Insulators"(4 pages).

*Primary Examiner*—Kristine Kincaid
*Assistant Examiner*—Kamand Cuneo
*Attorney, Agent, or Firm*—Wall Marjama Bilinski & Burr

[57] ABSTRACT

A composite insulator includes an insulating rod, an elastic insulating material molded around the insulating rod and having a plurality of shed portions, and end fittings fixedly fitted around opposite ends of the insulating rod. The end fittings cover the respective end portions of the elastic material. End faces of the end fittings abut respective shed portions of the elastic insulating material.

5 Claims, 3 Drawing Sheets

COMPOSITE INSULATOR HAVING END FITTINGS WITH GAPS

This is a continuation of application Ser. No. 08/600,128 filed Feb. 12, 1996, now abandoned.

BACKGROUND OF THE INVENTION (1) Field of the Invention

The present invention relates to composite insulators.

(2) Related Art Statement

A composite insulator having a structure as shown in FIG. 3 is known. That is, an elastic insulating material 12 is molded in the form of a rubber housing around the outer periphery of an insulating rod 10 made of a glass fiber-reinforced plastic (FRP) or the like. This housing includes a plurality of shed portions 11 (in FIG. 3, only one shed portion is illustrated). A pair of end fittings are fixedly crimped around respective end portions of the insulating rod 10 to partially hold these end portions. A straight portion 14 exists between an end of the end fitting 13 and an opposed shed portion 11 Straight portion 14 will be referred to hereinafter as "a sheath portion".

However, since the electric field concentrates near the end fitting 13, the sheath portion 14 of the elastic insulating material 12 tends to erode. This sheath portion 14 is thinner as compared with the shed portion 11, such that the insulating rod 10 is likely to be exposed through the erosion of this sheath portion 14. As a consequence, the insulating rod 10 deteriorates as a result of the exposure thereof.

In order to solve the above problem, a composite insulator having a structure as shown in FIG. 4 has been proposed. According to this composite insulator, an end fitting 15 is preliminarily crimped and fixed around each of opposite end portions of an insulating rod 16, and an elastic insulating material 17 is molded in the form of a rubber housing around the insulating rod 16 including parts of the end fittings 15. This composite insulator is constructed such that a shed portion 18 is continued to the end fitting 15 without a sheath portion 14 being interposed therebetween. Since the thickness of the shed portion 18 is thicker than the above-mentioned sheath portion, more tolerance is assured against the exposure of the insulating rod 16 even if the shed portion 18 suffers erosion.

However, in the latter conventional technique (FIG. 4), after the end fittings 15 are crimped around the insulating rod 16, the elastic rubbery insulating material 17 is molded. Therefore, since the insulating rod 16 experiences a certain heat history due to the heating during the molding process, fitting strength between the insulating rod 16 and the end fitting 15 decreases.

SUMMARY OF THE INVENTION

An object of the present invention, therefore, is to overcome the problems possessed by the above prior art, and is to provide a composite insulator which can prevent the deterioration of an insulating rod through erosion of an insulating material without reducing the fitting strength between the insulating rod and the end fitting.

In order to attain the above object, according to the present invention, the composite insulator is produced by molding the elastic insulating material around the insulating rod, and then fixedly fitting the end fittings around the respective end portions of the insulating rod such that end portions of the elastic insulating material are covered with the respective end fittings, and an end face of each end fitting comes up to a shed portion at an end side of the insulating material.

In this case, since the end fittings are fixedly fitted after the elastic insulating material is molded around the insulating rod, the fitting strength between the insulating rod and the end fittings is not diminished due to heat history of the insulating rod through heating during the molding process.

Moreover, the end fitting covers the end portion of the elastic insulating material and the end face of the end fitting abuts to the shed portion at the end side of the elastic insulating material. That is, the shed portion is located such that it may continue to the end fitting at which the electric field concentrates, and the above shed portion may be eroded. This shed portion is thicker as compared with the sheath portion, and as a result more tolerance is assured against the exposure of the insulating rod.

Further, the shed portion at each end side of the insulating material may be provided with a flange portion surrounding the end fitting.

In this case, the flange portion may be eroded. However, since this flange portion is provided under consideration of such erosion, no deterioration will be experienced by the composite insulator. In addition, the effective insulating length and the insulating surface distance can be increased by the provision of the flange portions, as compared with a conventional insulator having the same length. Consequently, the insulating tolerance of the composite insulator can be enhanced. Moreover, since the contact between the end fitting and the elastic insulating material has a complicated construction, water can be more effectively prevented from seeping into the gap therebetween.

Furthermore, a water seepage-preventing material may be filled in a gap between the end fitting and the elastic material. Therefore, water can be more assuredly prevented from seeping into this gap.

These and other objects, features and advantages of the invention will be appreciated upon reading of the following description of the invention when taken in conjunction with the attached drawings, with the understanding that some modifications, variations and changes may be easily made by the skilled in the art.

BRIEF DESCRIPTION OF THE DRAWINGS

For a better understanding of the invention, reference is made to the attached drawings, wherein.

DETAILED DESCRIPTION OF THE INVENTION

Figure 1:
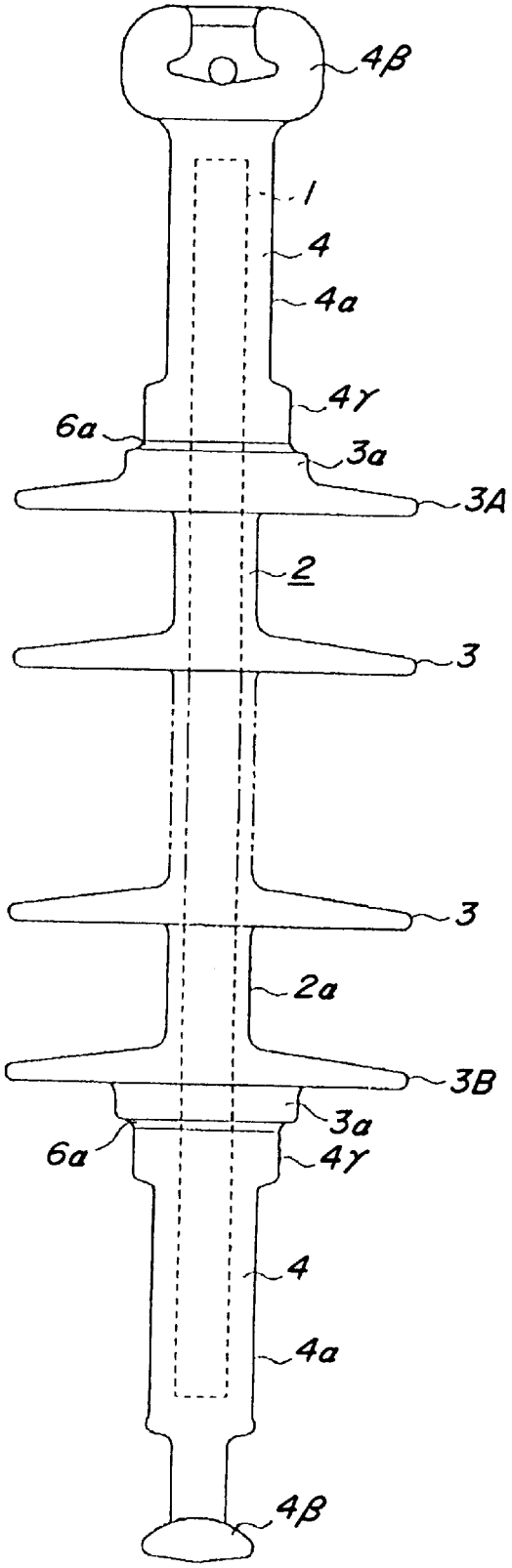
FIG. 1 is a front view of a composite insulator according to the present invention.

In the following, the present invention will be explained according to one embodiment shown in the drawings.

Figure 2A:
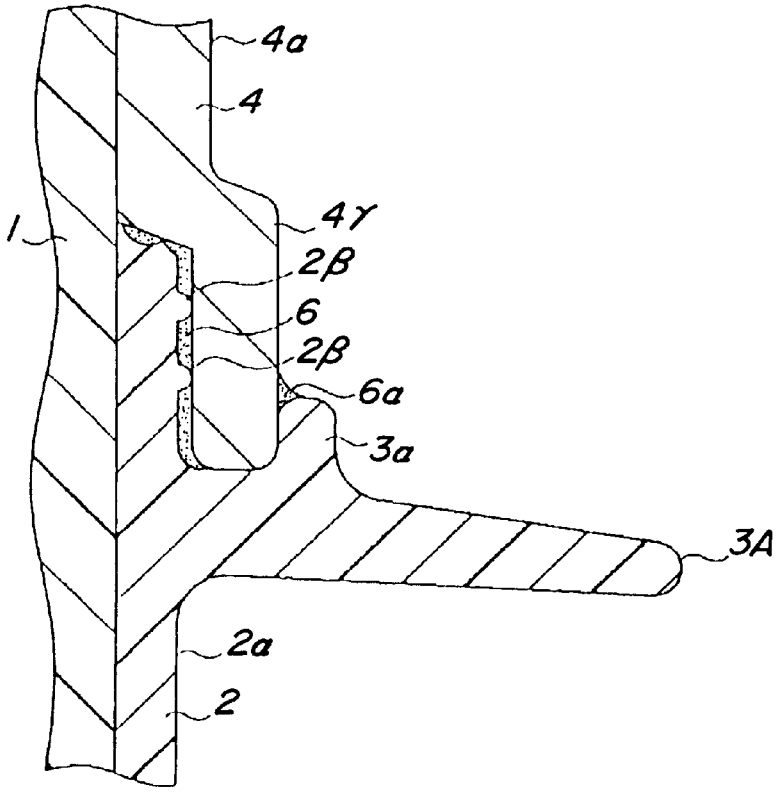
FIG. 2*a* is an enlarged sectional view of a part of a fitted portion of an upper end fitting, FIG. 2*b* being an enlarged sectional view of a part of a fitted portion of a lower end fitting.
Figure 2B:
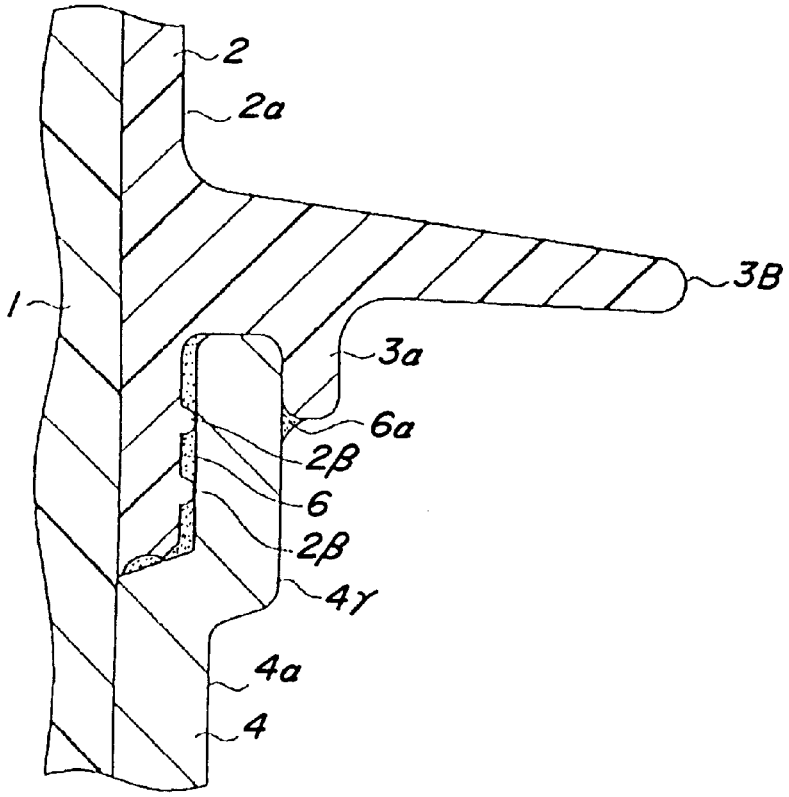

As shown in FIGS. 1, 2*a* and 2*b*, an insulating rod (hereinafter referred to as "rod") 1 is made of a glass fiber-reinforced plastic (FRP), and an elastic insulating material 2 such as silicone rubber or the like is molded around the outer periphery of the rod 1. The elastic insulating material 2 is composed of an insulating main body 2*a* having a constant thickness and a plurality of shed portions 3 integrally formed with the outer peripheral surface of the insulating main body 2α. A pair of annular sealing portions 2β are formed circumferentially at the outer peripheral surface of each end portion of the elastic insulating material 2.

In this embodiment, flange portions 3α are provided at an upper face of the shed portion 3A at the uppermost location (FIG. 2*a*) and at a lower face of the lowermost location (FIG. 2*b*), respectively, as viewed in FIG. 1 such that each flange portion 3α covers the end portion of the end fitting 4.

The end fitting 4 includes a cylindrical main body 4α and, a connecting portion 4β formed at one end of the main body 4α. The connecting portion is used to connect the end fitting 4 to, for example, a power line. End fitting 4 also includes a fitting portion 4γ formed at the other end of the main body 4α that has a diameter greater than that of the main body 4α.

The thus constituted end fitting 4 is fitted around an end portion of the rod 1 such that the end fitting 4 may cover an end portion of the elastic insulating material 2. The main body 4α of the end fitting 4 surrounds the end portion of the rod 1, and the fitting portion 4γ covers the end portion of the elastic insulating material 2. In this state, the end face of each fitting portion 4γ abuts the upper face of the shed portion 3A or abuts the lower face of the shed portion 3B at the end side of the elastic insulating material 2, and the flange portions 3α of the shed portions 3A and 3B surround the outer peripheries of the corresponding end portions of the fitting portions 4γ of the end fitting 4, respectively.

As mentioned above, the end fitting 4 are fitted around the outer periphery of the rod 1 and the elastic insulating material 2 at the end portion, and fixedly pressed against the rod and the elastic insulating material 2 by crimping two locations, i.e., the outer periphery of the main body 4α and the outer periphery of the fitting portion 4γ corresponding to the sealing portion 2β of the elastic insulating material 2.

Further, silicone rubber 6 is filled as a water seepage-preventing material in gaps between the inner peripheral surface of the end fitting 4 and the corresponding outer peripheral surface of the elastic insulating material 2. This silicone rubber 6 is preliminarily applied around the outer peripheral surface of the end portion of the elastic insulating material 2 before the end fitting 4 is fitted, and thereafter, the end fitting 4 is fitted and press fixed around the rod and the elastic insulating material as mentioned before. Thereby, the silicone rubber is uniformly filled between the elastic insulating material 2 and the end fitting 4. In the drawings, 6α denotes a portion of the silicone rubber coming out from the gaps through the press fixing, and the surface of the coming-out portion 6α is worked in a curved face.

Figure 3:
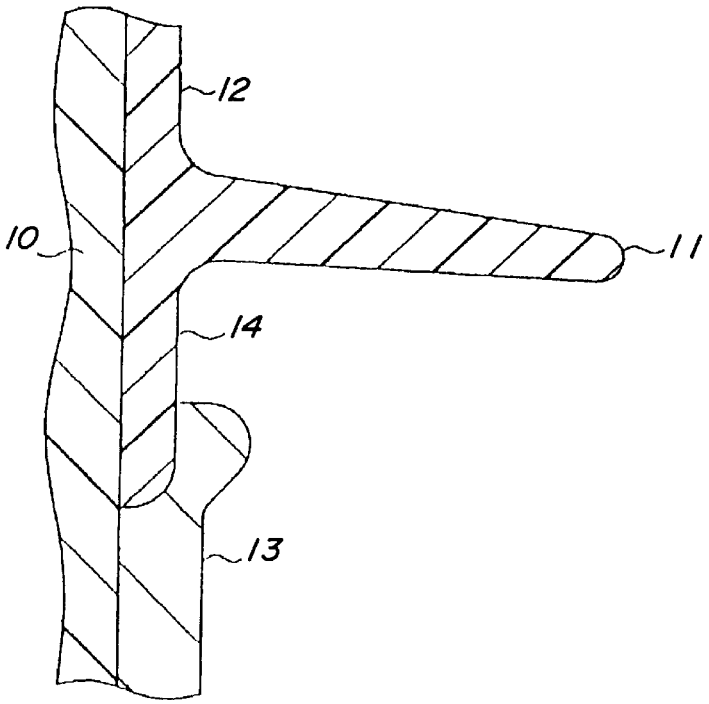
FIG 3 PRIOR ART
FIG. 3 is an enlarged sectional view of a principal portion of a conventional composite insulator.
Figure 4:
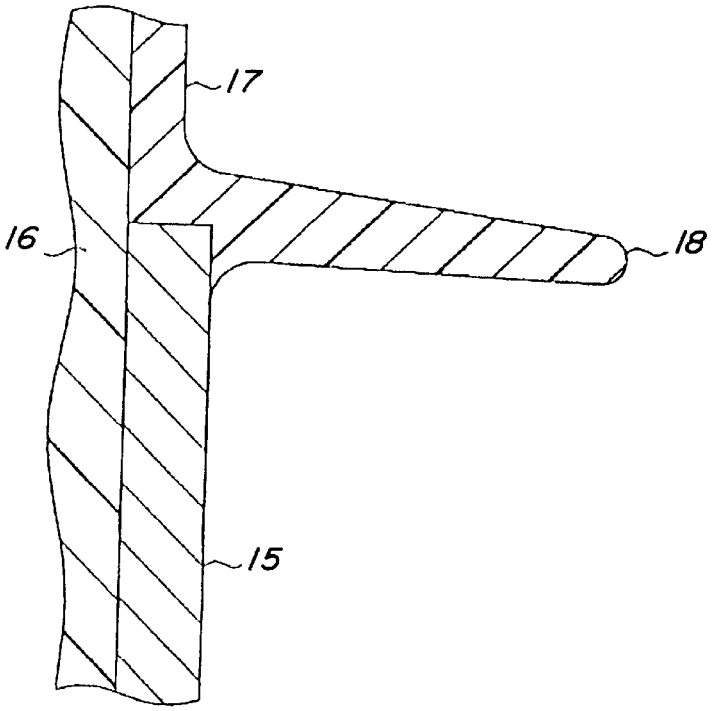
FIG 4 PRIOR ART
FIG. 4 is an enlarged sectional view of a principal portion of another conventional composite insulator.

In the composite insulator constructed above, the shed portions 3A and 3B of the elastic insulating material 2 adjacent the respective end fittings 4 are eroded by the concentration of the electric field near the end fittings 4. However, since the shed portions 3A and 3B are thick, the thickness of a portion of each shed portion that is to be eroded is greater as compared with the prior art shown in FIG. 3. Consequently, more tolerance is assured against the exposure of the rod 1. Therefore, the composite insulator can be prevented from being deteriorated through the exposure of the rod 1.

Furthermore, the flange portion 3α is formed at each of the shed portions 3A and 3B such that the flange portion 3α may surround the outer periphery of the fitting portion 4γ of the fitting end 4. Therefore, the above erosion of the shed portions 3A and 3B concentratedly occurs at the flange portions 3α continue to the end fittings 4, respectively. That is, since the flange portion 3α is provided to be sacrificed under consideration of the erosion, the function of the composite insulator will not be deteriorated even if the flange portion 3α is eroded. Further, the effective insulating length and the insulating surface distance of the composite insulator according to the present invention can be increased by the provision of the flange portions 3α, as compared with the conventional composite insulator having the same length. In addition, since the contact between the end fitting 4 and the elastic insulating material 2 has a complicated construction, i.e., the overlapping structure of the flange 3α and annular sealing portions 2β (described later herein), water can be more effectively prevented from seeping into the gap therebetween.

Moreover, if the end fittings 4 are crimped after molding the elastic insulating material 2, it is not expected as a result of the heating during molding the elastic insulating material 2 that the elastic insulating material 2 is well bonded to the end fitting 4. However, since silicone rubber 6 is filled between the end fitting 4 and the elastic insulating material 2, water can be prevented from seeping into the gap therebetween without any adverse effect.

In addition, the annular sealing portions 2β are projected at the outer periphery of the elastic insulating material 2 at each of the opposite ends. Therefore, a portion of the end fitting 4 that corresponds to a pair of the sealing portions 2β is crimped around the insulating material 2 so that the close fitting between the inner peripheral surface of the end fitting 4 and the elastic insulating material 2 may be enhanced by the presence of the sealing portions 2β (enhanced packing effect) and the above water seepage-prevented effect may be enhanced.

The present invention may be performed according to the following embodiments so long as they do not deviate from the scope of the invention.

(1) The flange portions 3α are omitted from the shed portions 3A and 3B.

(2) The shed portions 3 are formed separately from the main body 2α. For example, ring-shaped shed portions 3 are fitted and fixedly bonded around the main body 2α.

(3) The sealing portions 2β are formed separately from the elastic insulating material 2. In this case, one or more recesses are circumferentially formed around the outer peripheral surface of the end portion of the elastic insulating material 2, and a packing or the like is fitted into such a recess.

(4) The diameter of the upper and lower end shed portions 3A and 3B is increased over that of others to further prevent erosion.

The technical basis for the above-mentioned embodiment is explained below.

(a) The annular sealing portions 2β are provided at the outer peripheral surface of the elastic insulating material 2 at the opposite end portions. By so doing, the end fitting 4 can be more closely press fitted against the elastic insulating material by crimping.

(b) The sacrificing portion 3α that positively sacrifices itself is provided at the position 3 of the elastic insulating material 2 and continues to the end fitting. By so doing, the function of the composite insulator is not deteriorated by erosion.

As mentioned above, according to the present invention, since more tolerance is assured against the exposure of the insulating rod through the erosion of the elastic insulating material 2, the composite insulator can be prevented from being deteriorated due to the exposure of the insulating rod.

Further, when the shed of the elastic insulating material at the end portions is provided with the flange portion surrounding the corresponding end fittings, the function of the composite insulator can be prevented from being deteriorated by erosion, so that the insulating tolerance can be enhanced as compared with the conventional composite insulator having the same length.

Furthermore, when the water seepage-preventing material is filled in the gap between the end fitting and the elastic insulating material, water can be prevented from entering the gap between the elastic insulating material and the end fitting.

What is claimed is:

1. A composite insulator, comprising:

an insulating rod;

an elastic insulating material molded around the insulating rod and having a plurality of shed portions;

end fittings fixedly fitted around opposite ends of the insulating rod, wherein the end fittings cover respective end portions of the elastic insulating material, and end faces of the end fittings abut a respective one of said shed portions of the elastic insulating material on opposite end portions thereof; and a water seepage-preventing material disposed within a gap between each of the end fittings and the elastic insulating material, the gap extending substantially parallel to the longitudinal axis of the insulating rod and being defined substantially by a face of the elastic insulating material and a substantially parallel and opposed face of a corresponding one of the end fittings, the length of the gap being at least twice as long as the thickness of a portion of each of the end fittings defining the gap.

2. The composite insulator of claim 1, wherein each of said shed portions located on each of said end portions of the elastic insulating material is provided with a flange portion surrounding each of the end fittings.

3. The composite insulator of claim 1, wherein each of the end fittings comprises a cylindrical main body, a connecting portion formed at a longitudinally outer end of the main body, and a fitting portion formed at a longitudinally inner end of the main body and having a diameter larger than the main body, the main body surrounds an end portion of the insulating rod, the fitting portion covers an end portion of the elastic insulating material, and a longitudinally inner end face of the fitting portion extends up to an opposed face of each of said shed portions.

4. The composite insulator of claim 3, further comprising a flange portion provided at a longitudinally outer side of each of said shed portions located on each of the end portions of the elastic insulating material, said flange portion partially surrounding the outer periphery of the end portion of the corresponding one of said fitting portions of each of the end fittings.

5. The composite insulator of claim 4, wherein said water seepage-preventing material is disposed in said gap between each of the end fittings and that portion of the elastic insulating material defining said flange portion.

* * * * *